United States Patent [19]

Achelpohl et al.

[11] Patent Number: 4,605,392

[45] Date of Patent: Aug. 12, 1986

[54] APPARATUS FOR MAKING PLASTIC CARRIER BAGS

[75] Inventors: Fritz Achelpohl; Friedhelm Mundus, both of Lengerich; Wilfried Ebmeyer, Enger, all of Fed. Rep. of Germany

[73] Assignee: Windmoller & Holscher, Lengerich, Fed. Rep. of Germany

[21] Appl. No.: 656,999

[22] Filed: Oct. 2, 1984

[30] Foreign Application Priority Data

Oct. 5, 1983 [DE] Fed. Rep. of Germany ..... 3336231

[51] Int. Cl.[4] ..... B31B 23/86; B26D 1/06

[52] U.S. Cl. ..... 493/196; 493/372; 493/926; 83/428

[58] Field of Search ..... 493/22, 196, 203, 209, 493/226, 926, 372, 197, 227; 83/428

[56] References Cited

U.S. PATENT DOCUMENTS

| | | | |
|---|---|---|---|
| 204,145 | 5/1978 | Ford et al. | 83/428 |
| 1,127,448 | 2/1915 | Jullien | 83/428 |
| 2,942,529 | 6/1960 | Piazze | 493/196 |
| 3,282,525 | 11/1966 | Rehr | 83/428 |
| 4,365,051 | 1/1983 | Lehmacher | 493/11 |
| 4,398,903 | 8/1983 | Lehmacher | 493/197 |

FOREIGN PATENT DOCUMENTS

| | | |
|---|---|---|
| 3004220 | 8/1981 | Fed. Rep. of Germany . |
| 3004244 | 8/1981 | Fed. Rep. of Germany . |

*Primary Examiner*—Francis S. Husar
*Assistant Examiner*—William E. Terrell
*Attorney, Agent, or Firm*—Fleit, Jacobson, Cohn & Price

[57] ABSTRACT

In an apparatus for making plastics carrier bags from a web of tubular film of thermoplastic material, a feeding mechanism intermittently conveys the webs by one bag width and a severing mechanism cuts the web into half tubes along an undulating curve. A carriage displaceable in the machine frame transversely to the feeding direction of the web is reciprocated by a drive derived from a first rotating control cam through gearing. A cutting knife pivotable in the carriage about its longitudinal axis passes through the plane of the tube about an axis perpendicular thereto and is so controlled by an oscillating drive derived from a second rotating control cam that its edge is substantially tangential to the undulating curve at the cutting point. A detour assembly retards one of the half tubes to bring the bag side edge zones into phase and each half tube is formed into bags by a transverse sever-sealing device.

12 Claims, 10 Drawing Figures

APPARATUS FOR MAKING PLASTIC CARRIER BAGS

The invention relates to an apparatus for making plastics carrier bags from a web of tubular film of thermoplastic material, comprising feeding means intermittently conveying the web each time by the width of the bags to be made, severing means which cut the tubular web at its central region into half tubular webs along an undulating curve, are displaceable transversely to the motion of the tubular web and the knife of which is provided with control means for aligning same tangentially to the undulating curve, diverting means for displacing the half tubular webs longitudinally relatively to each other by half the width of the bags to be made, and transverse welding and severing means which simultaneously weld the bags off in pairs centrally through the troughs of the undulations of the half tubes aligned in mirror image to each other.

In an apparatus of this kind known from German documents Nos. DE-OS 30 04 220 and 30 04 244, corresponding to U.S. Pat. Nos. 4,398,903 and 4,368,051, for the purpose of moving the carriage carrying the severing means, a direction-changing roller is displaceably mounted on a guide arranged in the machine frame transversely to the feeding means of the web. The tubular web of film runs over the direction-changing roller which is intermittently driven with the feed rollers and is provided with an elliptical circumferential groove in which there runs a slide block for reciprocating the knife carriage. Parallel to this guide groove, the direction-changing roller is provided with a cutting groove which is likewise elliptical and in which the cutting knife engages, the knife being rotatably mounted on the carriage. To control the cutting knife tangentially of the undulating curve, a cam drive is provided which has its drive derived from the shaft of the direction-changing roller and so turns the cutting knife that its edge points longitudinally of the elliptical cutting groove. Since in the known apparatus the direction-changing roller serving to control the cutting direction and the cutting knife derives its drive from the intermittent drive of the feed rollers, additional masses have to be accelerated and braked during each machine cycle. Further, in the known apparatus, size adjustment, i.e. the manufacture of bags of different widths, is possible only if the tubular web of film runs over the cam-controlled direction-changing roller with slip, unless the direction-changing roller and the associated drive means are replaced as a whole.

If is therefore the problem of the invention to provide an apparatus of the aforementioned kind in which large masses do not have to be accelerated and braked to control the severing means.

According to the invention, this problem is solved in that a carriage displaceable in the machine frame transversely to the feeding direction of the tubular web is reciprocated by a drive derived from a first rotating control cam through gearing, and that a cutting knife rotatable or pivotable in the carriage about its longitudinal axis passes through the plane of the tube about an axis perpendicular to the tubular web and is so controlled by a rotary drive derived from a second rotating control cam that its edge is substantially tangential to the undulating curve at the cutting point on the undulating curve. In the apparatus according to the invention, the two control cams can be continuously driven despite the intermittent web feed, whereby periodic acceleration and braking of the equipment controlling the severing means are dispensed with. Further, in the apparatus of the invention an adjustment in size is possible by changing the speed. For this purpose, it is not necessary to have slip between the web and a direction-changing roller therefor.

Desirably, for reciprocating the carriage, one end of a lever is pivoted to the machine frame, the central region of the lever being supported on the circumferential surface of the control cam by way of a slide block or cam roller or running in a suitable control cam slot and the other end being hinged to the carriage directly or by way of a connecting rod.

In a further development of the invention, to turn the knife in the carriage, a lever pivoted in the machine frame and swung by the second control cam carries at its end facing the carriage an axial slide track in which there runs a slide block or roller arranged at the end of the control lever pivoting the knife. This lever may be mounted in the machine frame in its central region and carry at the end opposite the slide track a slide roller or slide block which runs in a guide groove or on the circumferential surface of the control cam.

Desirably, the drive of the control cams is derived from the main drive of the machine. The control cams may be co-axially arranged on a shaft.

For keeping the web taut and guiding it in the region of the knife, guide bars or rollers may be provided in pairs at both sides of the web and both sides of the knife.

In another embodiment of the invention, the carriage may be provided with a yoke which engages over the edge of the tubular web and is provided at the end of its outer limb with a rotatably mounted disc in which the upper end of the knife is mounted. The web is guided between the limbs of the yoke so that it cannot be deflected during the cut. To relieve the knife from carrying along the disc, a permanent magnet on the knife shaft below the knife can carry along the disc of magnetic material.

In a further embodiment of the invention, the rotary drive of the knife is derived from a lever which is swung by the second control cam and is pivotably mounted on the lever that moves the carriage. In this embodiment, driving means are saved and the construction of the control cams is simplified.

To permit the bags to be welded off the parallel half tubes in a juxtaposed position, at least one device may be provided between the cutting means and the transverse welding and separating means consisting of two parallel turning bars to displace the associated half tube outwardly parallel to itself.

The undulating cut is carried out so that the troughs of the undulation are complementary to the peaks. The shape of the undulations is chosen so that they later form attractive handles at the edges of the bags. The region of the tubular film through which the undulating cut is made can be reinforced by extrusion so that the bags have reinforced handles.

Examples of the invention will now be described in more detail with reference to the drawing, wherein.

Figure 1:
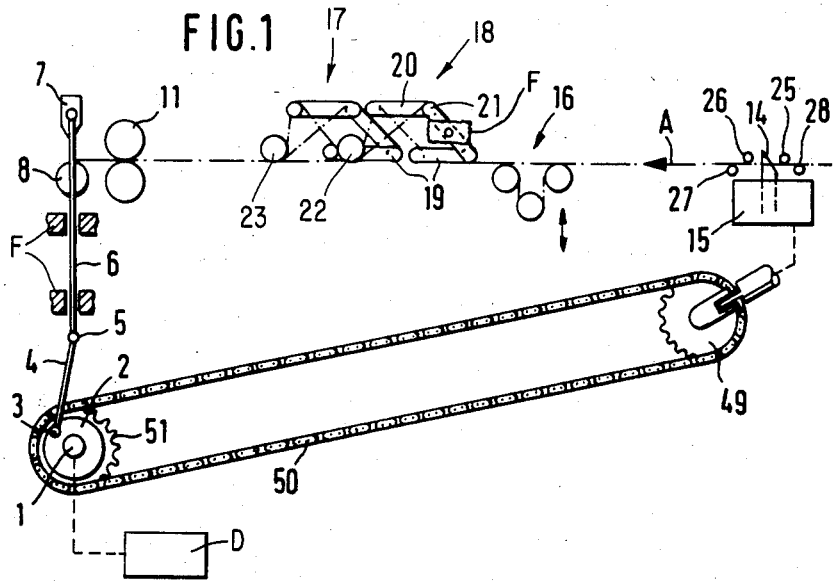
FIG. 1 is a diagrammatic side elevation of the apparatus for making plastics carrier bags.
Figure 2:
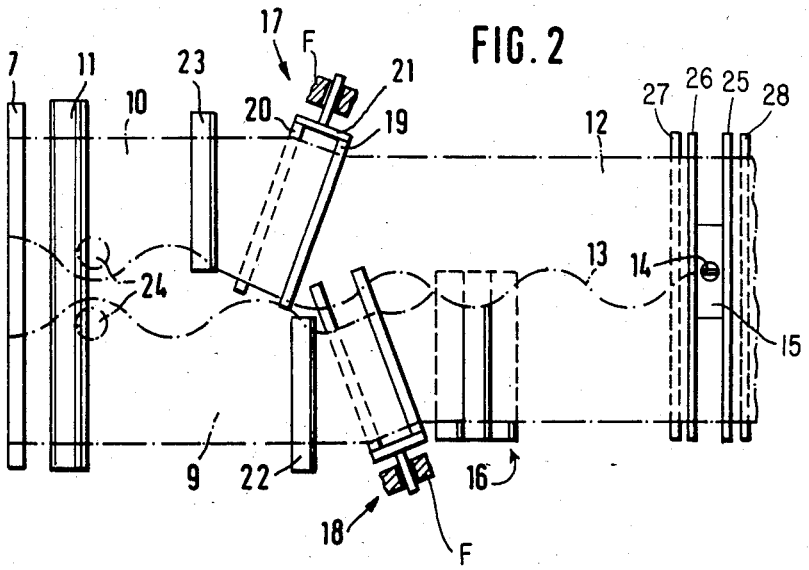
FIG. 2 is a plan view of the FIG. 1 apparatus.
Figure 3:
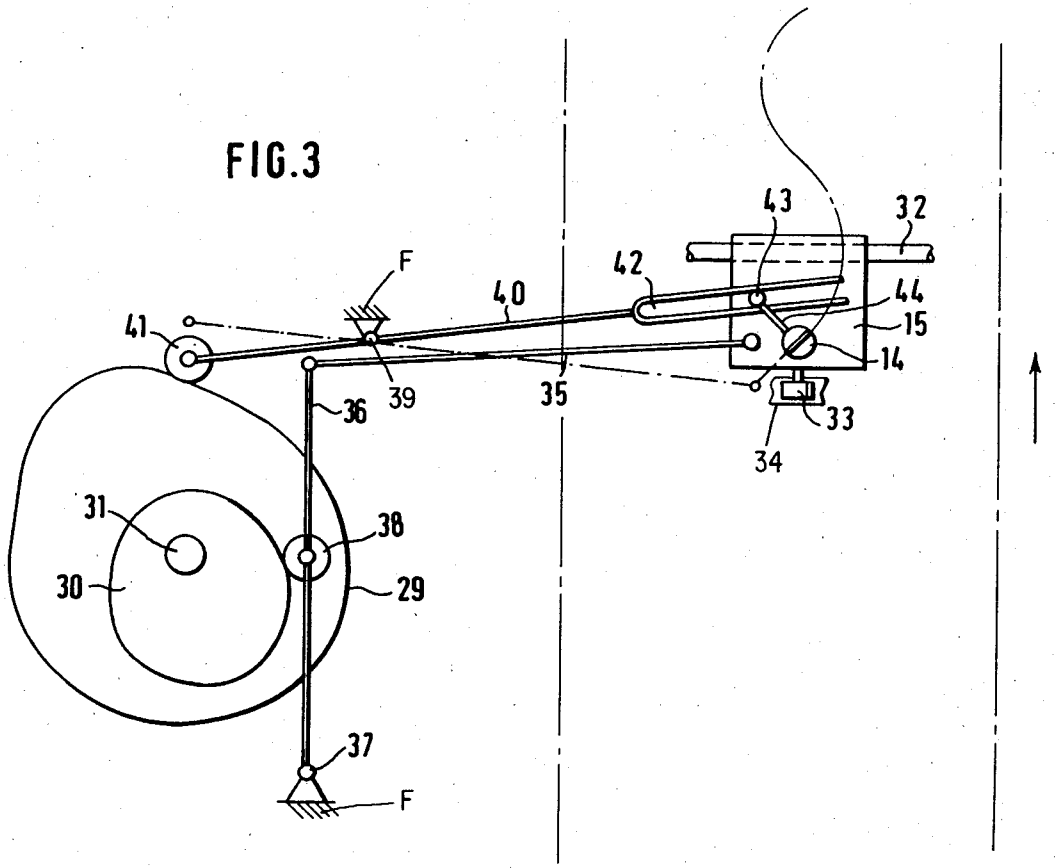
FIG. 3 is a plan view of the control of the carriage carrying the cutting knife and of the cutting knife.
Figure 4:
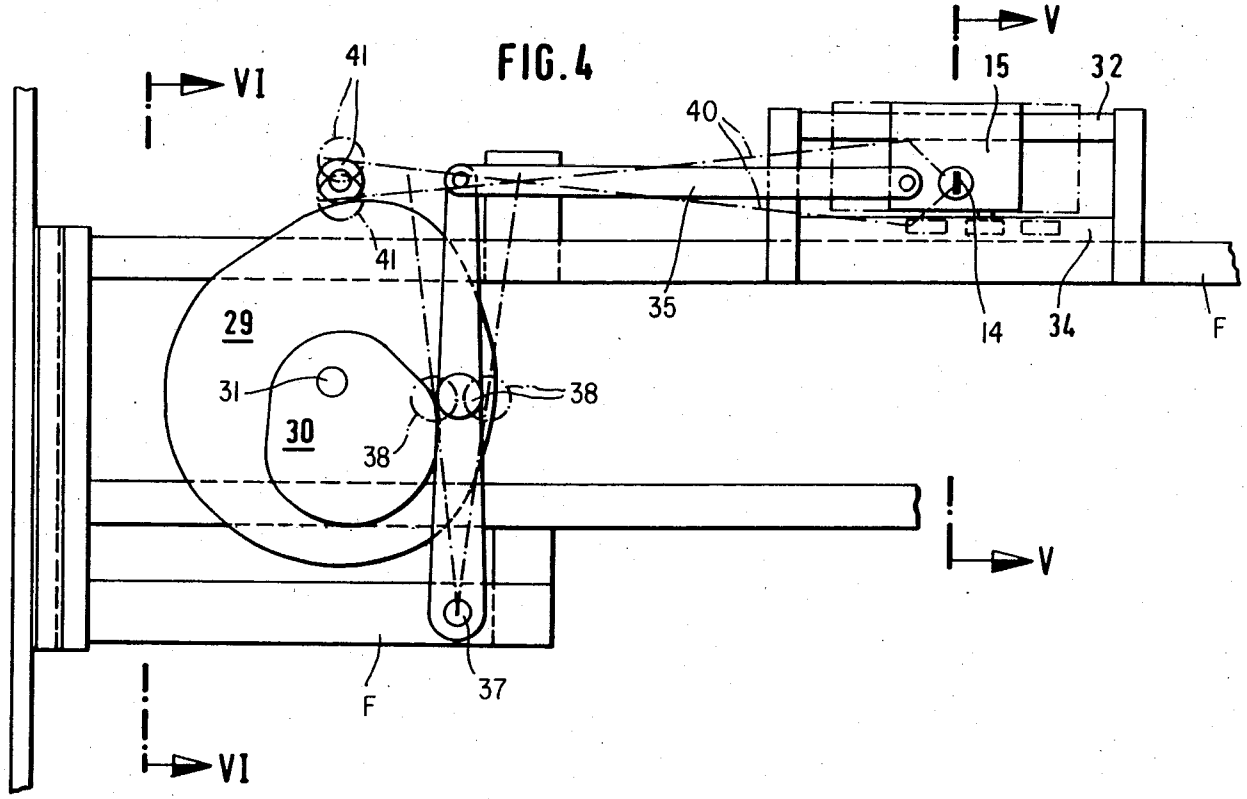
FIG. 4 is a view corresponding to FIG. 3 of the control with different positions of the drive levers.

For the sake of clarity, the drawing only shows the main components of the apparatus for making plastics carrier bags but not the entire machine frame F and other components that are here not relevant for a proper understanding.

The main drive D (FIG. 1) of the machine continuously drives the shaft 1 on which the crank plate 2 is keyed. The pin 3 on which the connecting rod 4 is mounted is eccentrically secured to the crank plate 2.

The connecting rod 4 is connected at the joint 5 to the rod 6 which is axially displaceable in the machine frame F and is connected by lateral supports to the upper welding and severing jaw 7 co-operating with the backing welding roller 8 which is conventionally mounted and driven in the machine frame F.

The half tubular webs 9, 10 are intermittently advanced in sequence with the machine cycle by the pair of drive rollers 11 by one width of the bags to be made. They stand still during the welding cycle.

The half tubular webs 9, 10 are made in that the supplied tubular web 12 is cut in its central region by a substantially sinusoidal cut 13. This separating cut is made by the knife or cutting member 14 which is rotatable or pivotable about the vertical knife axis in the carriage 15 which is reciprocated by control means transversely to the web motion according to the amplitude of the undulating cut. After the sinusoidal separating cut has been executed, the half tubular web 9 runs over diverting means 16 which consists of three rollers and displace the half tubular webs 9, 10 relatively to each other by half the width of the bags to be made so that the two half tubular webs are disposed in mirror image relationship.

Between the diverting means 16 and the feed rollers 11, there are means 17, 18 which displace the half tubular webs 9, 10 parallel to themselves and separate them from each other so far that their parts which later form the handles no longer overlap. The means 17, 18 displacing the half tubular webs consist of two parallel and oblique deflecting rods 19, 20 which are interconnected by a support plate 21. To enable the displacement to be adjustable, the means 17, 18 are rotatable and pivotable in the machine frame F. The half tubular webs 9, 10 running off the displacement means then move over the guide rollers 22, 23. Before the half tubular webs enter the welding station, the handles formed by the peaks of the undulations are provided with hand holes 24 by stamping means (not shown).

To hold the web 12 taut in the region of the separating cut, the knife 14 is arranged between guide rods 25, 26, 27, 28 arranged in pairs at both sides of the web.

The control of the cutting knife 14 is effected by the cam plates 29, 30. These are secured in parallel planes on the shaft 31. The carriage 15 is guided on a rod 32 secured in the machine frame F transversely to the feeding direction A of the web. On its opposite side, the carriage has a roller 33 by which it is supported on a rail 34. The carriage 15 is reciprocated by a connecting rod 35 hinged to the lever 36 which is pivotable about the fulcrum 37 in the machine frame F.

In the central region of the pivot lever 36, it carries a roller 38 which runs on the circumferential surface of the cam 30 and is pressed to it by a spring (not shown).

The two-armed lever 40 pivoted in the machine frame F at 39 carries at one end the cam roller 41 which runs on the periphery of the cam plate 29. At its other end, the two-armed lever 40 is provided with a bifurcated or grooved guide 42. In it there runs the roller 43 mounted at the end of the control lever 44 which is fixed to the shaft of the cutting knife 14.

The shaft 31 carrying the cam plates 29, 30 is the output shaft of the bevel gearing 45, of which the input shaft 46 is driven by the cardan shaft 47 which is connected to the shaft 48 on which the sprocket 49 is keyed. The sprocket 49 is driven by a drive chain 50 from a sprocket 51 which is keyed to the drive shaft 1.

The cam plates 29, 30 are driven continuously with the machine drive. The cam plates have constant-radius sections on which the cam rollers 38, 41 run when the severing means are stationary during the intermittent stand stills of the web.

Figure 5:
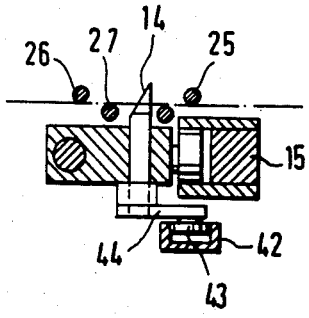
FIG. 5 is a section through the carriage on the line V—V in FIG. 4.
Figure 6:
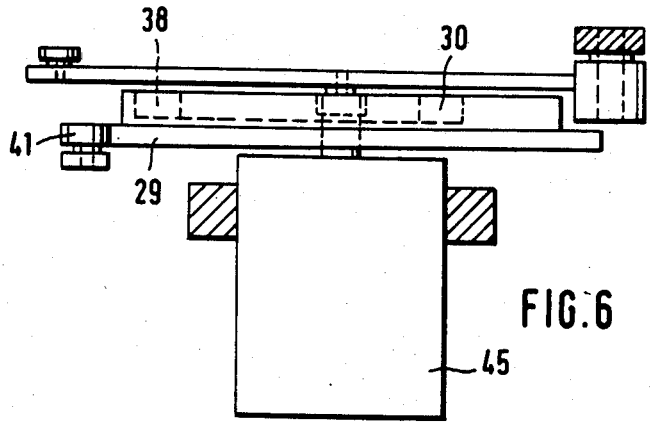
FIG. 6 is a section of the control means on line VI—VI in FIG. 4.
Figure 7:
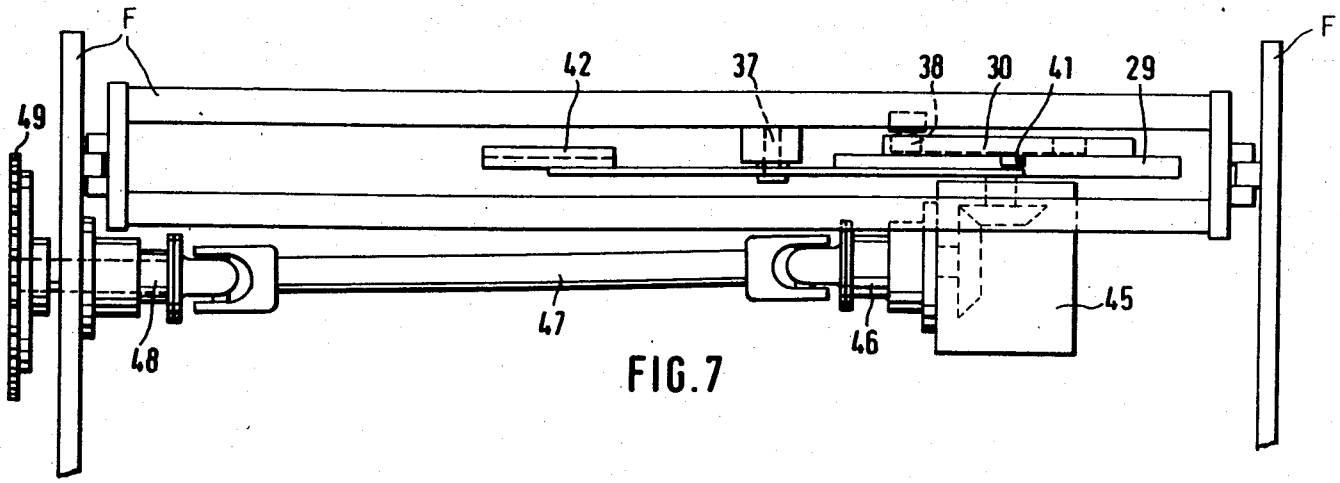
FIG. 7 is a side elevation of the control means with drive means.
Figure 8:
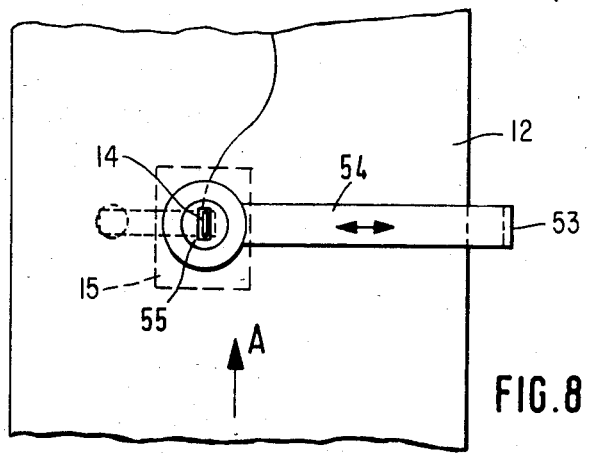
FIG. 8 is a plan view of a different embodiment of the carriage.

FIG. 5 shows the construction of the carriage 15 and the knife 14 rotatably mounted therein. The knife shaft is mounted in the carriage 15 and provided with the control lever 44.

Figure 9:
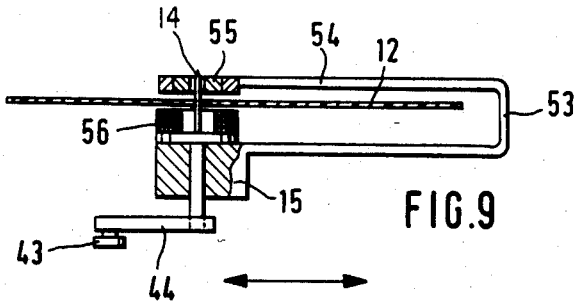
FIG. 9 is a section through the FIG. 8 carriage.

In the FIG. 9 embodiment, the carriage 15 is provided with a yoke 53 which engages over the edge of the tubular web 12. A disc 55 easily rotatable in the end of the upper limb 54 of the yoke is provided with a central slot in which the upper edge of the cutting knife 14 is held. Below the tubular web 12, a permanent magnet 56 secured to the knife shaft uses its magnetic force to turn the disc 55 and rotate the cutting knife.

Figure 10:
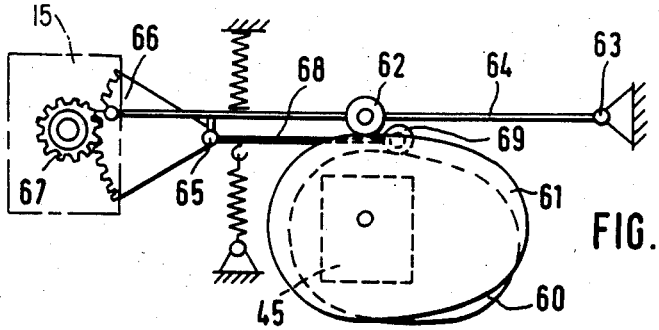
FIG. 10 is a diagrammatic plan view of different control means for the carriage and of the cutting knife.

In the embodiment of FIG. 10, the cam plates 60, 61 are driven in the manner previously described by the output shaft of the bevel gearing 45. Running over the circumference of the cam plate 61 there is the roller 62 which is arranged in the central region of the lever 64 mounted in the frame by the pivot 63. The knife carriage 15 is connected to the end of the lever 64 in a manner not shown for the purpose of its reciprocating drive. The lever 64 is provided in a manner not shown with a plug connection to bring about compensation for length.

The gear segment 66 pivoted to the lever 64 at the pivot 65 engages the pinion 67 which adjusts the knife tangentially of the undulating curve. The gear segment 66 forms one arm of a two-armed lever of which the end of the other arm 68 carries a cam roller 69 running on the periphery of the cam plate 60. The levers 68 and 64 are pressed against the circumferential surfaces of the cam plates by the illustrated springs.

We claim:

1. Apparatus for making plastic carrier bags of a preselected width from a tubular web of plastic film material, comprising:

feeding means for intermittently feeding the tubular web along a path in successive steps each corresponding to the width of the bags to be made;

cutting means along said path for cutting the tubular web at a central region thereof into half tubular webs along an undulating sinusoidal curve to form undulations having peaks and troughs in adjacent edges of the half tubular webs, said cutting means including a cutting member;

a carriage mounted for movement transversely to the feeding direction of the tubular web, said cutting member of said cutting means being pivotably mounted on said carriage for pivoting movement about an axis perpendicular to a plane of the tubular web;

first lever means for reciprocating said carriage transversely of the direction of advancement of the tubular web in synchronism with the intermittent feeding of the tubular web by said feeding means, such that said cutting member cuts the tubular web along the undulating sinusoidal curve, said first lever means being pivotably mounted adjacent one end and being pivotably connected adjacent an opposite end to said carriage;

means comprising a first continuously driven control cam engaged with said first lever means for oscillating said first lever means to cause reciprocation of said carriage in said synchronism;

second lever means for pivoting said cutting member in synchronism with the reciprocation of said carriage by said first lever means and the intermittent feeding of the tubular web by said feeding means, so as to maintain said cutting member substantially tangential to the undulating curve at the cutting point of the undulating curve, said second lever means being pivotably mounted and having one end connected to said pivotably mounted cutting member;

means comprising a second continuously driven control cam engaged with said second lever means for pivoting said second lever means and thereby pivoting said cutting member in said synchronism;

diverting means along said path for displacing the half tubular webs longitudinally relative to each other by half the width of the bags such that respective ones of the peaks and troughs of the half tubular webs are in an aligned opposed mirror image relationship to each other; and transverse welding and cutting means along said path for simultaneously welding and cutting the half tubular webs centrally through respective ones of the troughs of the half tubular webs which are in aligned opposed mirror image relationship to each other, to form the plastic tubular carrier bags.

2. Apparatus according to claim 1 wherein said first lever means for reciprocating the carriage includes a lever which is pivoted at one end to a machine frame, has a central region supported on the first control cam, and has a second end pivotably connected to a connecting rod pivotably connected to the carriage.

3. Apparatus according to claim 1, wherein said second lever means for pivoting the cutting member in the carriage includes a lever which is pivoted in the machine frame and has at an end adjacent the carriage, an axial slide track which receives a member mounted at an end of a control lever for pivoting the cutting member.

4. Apparatus according to claim 3, wherein said lever is pivotably mounted in the machine frame at a central region of said lever and carries at an end opposite the slide track a member which engages the second control cam.

5. Apparatus according to claim 1, wherein the continuous drive of the control cams is derived from a main drive of the machine.

6. Apparatus according to claim 1, wherein the control cams are co-axially mounted on a same shaft.

7. Apparatus according to claim 1, further comprising, in the vicinity of the cutting member, tubular web guide bars or rollers arranged in pairs on both sides of the cutting member and the web.

8. Apparatus according to claim 1, further comprising a yoke on the carriage which slides over one edge of the tubular web and which is provided at an outer end with a rotatable disc in which an upper end of the cutting member is mounted.

9. Apparatus according to claim 8 wherein the rotatable disc is of magnetic material and a permanent magnet is mounted on a cutting member mounting shaft below the cutting member for rotating the disc of magnetic material.

10. Apparatus according to claim 1, wherein the second lever means for pivoting the cutting member includes a lever which is pivoted by the second control cam and is pivotably mounted on a lever of the first lever means for moving the carriage.

11. Apparatus according to claim 10, wherein the lever of the second lever means includes a gear segment engaged with a gear mounted on the cutting member.

12. Apparatus according to claim 1, further comprising, between the cutting means and the transverse welding and cutting means, at least one device which comprises two parallel turning bars for displacing a respective one of the associated half tubular webs outwardly parallel to itself.

* * * * *